US009997046B2

(12) United States Patent
Bermudez Rodriguez et al.

(10) Patent No.: US 9,997,046 B2
(45) Date of Patent: Jun. 12, 2018

(54) VISITOR FLOW MANAGEMENT

(71) Applicant: International Business Machines Corporation, Armonk, NY (US)

(72) Inventors: Sergio A. Bermudez Rodriguez, Boston, MA (US); Levente Klein, Tuckahoe, NY (US)

(73) Assignee: International Business Machines Corporation, Armonk, NY (US)

( * ) Notice: Subject to any disclaimer, the term of this patent is extended or adjusted under 35 U.S.C. 154(b) by 31 days.

(21) Appl. No.: 14/985,920

(22) Filed: Dec. 31, 2015

(65) Prior Publication Data

US 2017/0193792 A1 Jul. 6, 2017

(51) Int. Cl.

| | |
|---|---|
| ***G08B 23/00*** | (2006.01) |
| ***G08B 21/18*** | (2006.01) |
| ***G08B 21/22*** | (2006.01) |
| ***G08B 5/22*** | (2006.01) |

(52) U.S. Cl.
CPC ..... *G08B 21/182* (2013.01); *G08B 5/224* (2013.01); *G08B 21/22* (2013.01)

(58) Field of Classification Search
None
See application file for complete search history.

(56) References Cited

U.S. PATENT DOCUMENTS 6,614,348 B2 9/2003 Ciccolo et al.
7,676,280 B1 3/2010 Bash et al.
7,761,310 B2 7/2010 Rodgers
8,306,794 B2 11/2012 Hamann et al.
8,346,618 B2 * 1/2013 Brooks ..... G06Q 30/00 705/26.1
8,437,984 B2 5/2013 McGreevy et al.
8,629,755 B2 * 1/2014 Hashim-Waris ... G06Q 30/0235 340/10.1

(Continued)

OTHER PUBLICATIONS

Zhao et al., "Understanding Packet Delivery Performance in Dense Wireless Sensor Networks," Proceedings of the 1st International Conference on Embedded Networked Sensor Systems, SenSys '03 pp. 1-13 (Nov. 2003).

(Continued)

*Primary Examiner* — Julie Lieu
(74) *Attorney, Agent, or Firm* — Vazken Alexanian; Michael J. Chang, LLC

(57) ABSTRACT

Techniques for managing visitor flow in environments on which the visitors can have an impact are provided. In one aspect, a method for managing visitor flow in an indoor space is includes the steps of: obtaining real-time data from a wireless sensor network present in the indoor space, wherein the data indicates a presence/number of visitors in the indoor space and an environmental condition(s) in the indoor space; creating a risk map using the real-time data which indicates an impact the presence/number of visitors have on the environmental conditions in the indoor space; and generating an alert whenever the risk map indicates that the presence/number of visitors have greater than a pre-defined threshold impact on the environmental conditions in the indoor space. Systems for managing visitor flow in indoor spaces such as a gallery of a museum or a room in a hospital are also provided.

20 Claims, 5 Drawing Sheets

(56) References Cited

U.S. PATENT DOCUMENTS

| | | | | |
|---|---|---|---|---|
| 8,844,029 | B2 | 9/2014 | Sakaki | |
| 2017/0124824 | A1* | 5/2017 | Chan | G08B 13/22 |

OTHER PUBLICATIONS

Fernstrom et al., "Aerobiology and Its Role in the Transmission of Infectious Diseases," Journal of Pathogens, vol. 2013, Article ID 493960, Jan. 2013, 13 pages.

Y. Amemiya et al., "Comparison of Experimental Temperature Results with Numerical Modeling Predictions of a Real-World Compact Data Center Facility," Proceedings of IPACK2007 ASME InterPACK '07 pp. 1-6 (Jul. 2007).

Lawrence, "The Relationship between Relative Humidity and the Dewpoint Temperature in Moist Air, A Simple Conversion and Applications," American Meteorological Society, pp. 225-233 (Feb. 2005).

Lowen et al., "Roles of Humidity and Temperature in Shaping Influenza Seasonality," Journal of Virology, vol. 88, No. 14 7692-7695 (Jul. 2014).

Yang et al., "Dynamics of Airborne Influenza A Viruses Indoors and Dependence on Humidity," PLoS ONE 6(6): e21481 pp. 1-10 (Jun. 2011).

Tang, "The effect of environmental parameters on the survival of airborne infectious agents," J. R. Soc. Interface (Sep. 2009) 6, S737-S746.

A.C. Lowen et al., "Influenza virus transmission is dependent on relative humidity and temperature," PLoS Pathogens, vol. 3, No. 10, Oct. 2007, e151, pp. 1470-1476.

M. Leung et al., "Control and management of hospital indoor air quality," Medical Science Monitor, vol. 12, No. 3, Mar. 2006, pp. SR17-SR23.

K. Gysels et al., "Indoor environment and conservation in the Royal Museum of Fine Arts, Antwerp, Belgium," Journal of Cultural Heritage, vol. 5, No. 2, Apr. 2004, pp. 221-230.

T. Prosek et al., "Real-time monitoring of indoor air corrosivity in cultural heritage institutions with metallic electrical resistance sensors," Studies in Conservation, vol. 58, No. 2, Apr. 2013, pp. 117-128.

A. Kumar et al., "Environmental monitoring systems: a review," IEEE Sensors Journal, vol. 13, No. 4, Feb. 2013, pp. 1329-1339.

C.-T. Yang et al., "Construction and application of an intelligent air quality monitoring system for healthcare environment," Journal of Medical Systems, vol. 38, No. 2, Feb. 2014, 10 pages.

* cited by examiner

VISITOR FLOW MANAGEMENT

FIELD OF THE INVENTION

The present invention relates to controlling an impact of visitors on an environment, and more particularly, to techniques for assessing and managing visitor flow in environments on which the visitors can have an impact, such as museum or a hospital.

BACKGROUND OF THE INVENTION

The presence of people in a room can change the local microenvironment of the space, for example raising temperature, or altering relative humidity, carbon dioxide ($CO_2$) or volatile organic compound (VOC) levels. This affect can have significant impacts on certain environments that commonly host large numbers of visitors.

For example, a museum has to preserve objects of art for very long periods of time—several hundreds of years—and usually contains multiple galleries where large numbers of people can gather to appreciate the art pieces. Some works of art are very susceptible to environmental variations, and some of those variations can be caused by the presence of large groups of people affecting the microenvironment in the museum. While air conditioning systems are often in place to control the temperature, humidity, etc. they are typically only able to react to changes in the environment which have already occurred. By that time, the movement of visitors through the museum may have already changed, thus warranting a different set of adjustments. Additionally, the objects may be packaged in an enclosure to protect them from environmental fluctuations—but these will alter the aesthetic appreciations of art objects and is usually a very expensive procedure. Therefore, being able to track, manage, and anticipate the movement of visitors through a museum such that proactive measures can be taken to adjust for the visitors' impact on the environment would be desirable.

Further, the presence of visitors in an environment can also alter the chemical and biological composition of the air by dispersing disease-causing bacteria into the air. Such is the case for the risk of spreading flu in any place where multiple people gather like: athletic facilities, health care facilities, dormitories, schools, daycare settings, military barracks, prisons, museums, etc. In environments like hospitals, special precautions can be taken to reduce the exposure risk—like isolating patients. However, such actions are very expensive. Another, technique to reduce risks is to control the exposure of patients to visitors whose presence may increase a risk/hazard of infection to the patients. Therefore, being able to track and manage visitors to a hospital so as to be able to control an impact the visitors have on the environment would be desirable.

SUMMARY OF THE INVENTION

The present invention provides techniques for assessing and managing visitor flow in environments on which the visitors can have an impact, such as museum or a hospital. In one aspect of the invention, a method for managing visitor flow in an indoor space is provided. The method includes the steps of: obtaining real-time data from a wireless sensor network present in the indoor space, wherein the real-time data indicates a presence and a number of visitors in the indoor space and one or more environmental conditions in the indoor space; creating a risk map using the real-time data, wherein the risk map indicates an impact the presence and the number of visitors have on the environmental conditions in the indoor space; and generating an alert whenever the risk map indicates that the presence and the number of visitors have greater than a predefined threshold impact on the environmental conditions in the indoor space.

In another aspect of the invention, a system for managing visitor flow in a gallery of a museum containing one or more particular works of art is provided. The system includes: a computational fluid dynamics (CFD) modeling module configured to obtain real-time data relating to one or more environmental conditions in the gallery from a wireless sensor network present in the gallery, and create a rapid CFD model of the gallery; a human body modeling module configured to obtain real-time data relating to a presence and a number of visitors in the gallery from the wireless sensor network, and create a human body model that indicates an amount of one or more of a temperature, a relative humidity, and a $CO_2$ level in the gallery that is attributable to the presence and the number of visitors in the gallery; a preservation modeling module configured to create a preservation model based on characteristics of the particular works of art in the gallery; and a blending module configured to combine the CFD model, the human body model, and the preservation model to create a risk map to determine an impact the environmental conditions in the gallery have on the particular works of art in the gallery.

In yet another aspect of the invention, a system for managing visitor flow in a room in a hospital having one or more patients is provided. The system includes: a CFD modeling module configured to obtain real-time data relating to one or more environmental conditions in the room from a wireless sensor network present in the room, and create a CFD model of the room; a human body modeling module configured to obtain real-time data relating to a presence and a number of visitors in the room from the wireless sensor network, and create a human body model that indicates an amount of one or more of a temperature, a relative humidity, and a $CO_2$ level in the room that is attributable to the presence and the number of visitors in the room; a risk of infection modeling module configured to create a risk of infection model based on characteristics of the patients in the room; and a blending module configured to combine the CFD model, the human body model, and the risk of infection model to create a risk map to determine an impact the environmental conditions in the room have on a risk of infection for the patients.

A more complete understanding of the present invention, as well as further features and advantages of the present invention, will be obtained by reference to the following detailed description and drawings.

DETAILED DESCRIPTION OF PREFERRED EMBODIMENTS

Provided herein are techniques for tracking and managing visitor movements through indoor environments on which the visitors' presence can have an impact. Two exemplary scenarios involving environments affected by the presence of visitors will be provided herein. However, the present techniques are more generally applicable to any environment through which it is desirable to be able to track and manage the flow of people. In case adverse effects are determined, action can be taken by changing air flow, temperature or relative humidity with a room, limit the number of people in a certain location, or reroute them to other locations to minimize risk for patients.

As highlighted above, a museum is a type of environment that is particularly susceptible to the presence of visitors. Namely, the delicate nature of the works of art makes a museum sensitive to changes in the environment. Large numbers of visitors can cause changes to the environment in a museum that can have a significant negative impact on the artwork. A hospital is another type of environment that is susceptible to the presence of visitors. Visitors to a hospital can alter the chemical and biological content of the air and/or cause unstable environmental conditions (such as changes to the temperature, relative humidity, volatile organic compounds (VOCs) etc.)—all of which can increase the risk of disease transmission. In these, and similar environments, a useful tool in regulating and controlling the environment is to be able to manage the flow of visitors through the environment. In the museum setting, for example, being able to track the movement of visitors through the various galleries of the museum would enable real-time predictions to be made as to the volume of visitors that will be present in a given gallery at any point in time, and proactive adjustments to the environment (e.g., increasing/decreasing cooling via the air conditioning) can be made ahead of time to account for the impact (e.g., temperature, humidity, etc.) the visitors will have on the environment. Further, movement of the visitors through the museum can also be regulated to reduce crowding in individual galleries of the museum, and thereby make the changes to the environment less drastic. The navigation/route of visiting can be adjusted dynamically and this change can be delivered to the visitor either as a map displayed on a mobile devices, indicated by lights on the wall that indicate the path to follow, or have audio guidance/warning. This also has the added benefit of enhancing the visitors' experience, since they will encounter less crowds and more comfortable spaces. In the hospital setting, for example, the risk of disease transmission can be reduced by controlling the amount of visitor traffic through a hospital. This has the added benefit of also reducing the exposure of visitors to pathogens present in the hospital.

Figure 1:
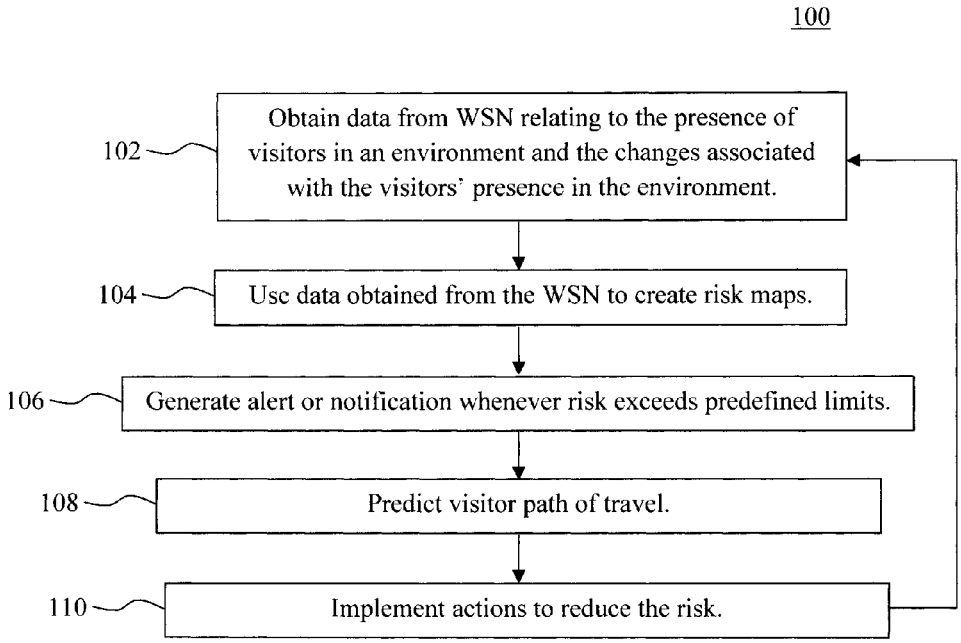
FIG. 1 is a diagram illustrating an exemplary methodology for managing visitor flow in an indoor space according to an embodiment of the present invention.

An overview of the present techniques is now provided by way of reference to methodology 100 of FIG. 1 for managing visitor flow in an indoor space, such as a gallery in a museum or room in a hospital. According to an exemplary embodiment, the present techniques leverage data obtained by a wireless sensor network. The nodes in a wireless sensor network, also called motes, are small, energy efficient devices, typically powered by batteries that are interconnected form a mesh network. Each mote is fitted with one or more sensors configured to measure/detect a characteristic of the environment, such as temperature, relative humidity, carbon dioxide ($CO_2$) levels, VOC levels, motion, airborne biological and/or chemical matter, light intensity, etc. For instance, in accordance with the present techniques, passive infrared sensors may be employed in the motes to detect the presence and/or count the number of people (visitors) present in the environment. Suitable sensors for use in accordance with the present techniques are commercially available. The nodes in a wireless sensor network can transmit data (wirelessly) in between nodes and/or to a gateway which aggregates and manages data collected from the nodes in the network.

In order to obtain fine-grained measurements, the wireless sensor network is preferably densely distributed throughout the environment. By way of example only, densely deployed wireless sensor networks contain on the order of tens of nodes within communication range. See, for example, Zhao et al., "Understanding Packet Delivery Performance In Dense Wireless Sensor Networks," Proceedings of the 1 st International Conference on Embedded Networked Sensor Systems, SenSys '03 pgs. 1-13 (November 2003), the contents of which are incorporated by reference as if fully set forth herein.

Accordingly, in step 102, data is obtained from the wireless sensor network (WSN) relating to the presence of visitors in the environment and the changes associated with his/her presence in the environment. By way of example only, the presence and/or the number of persons in the environment can be determined using the passive infrared sensors in the wireless sensor network. The environmental impact of the visitors on the environment can be determined using the temperature, relative humidity, $CO_2$ levels, VOCs, motion (i.e., vibration), airborne biological and/or chemical matter, light intensity, etc. sensors in the wireless network.

In addition to the presence of visitors, other factors can also cause changes in an indoor environment. For instance, depending on the particular season the outdoor environment can have an impact on parameters such as air quality in the environment, e.g., $CO_2$ levels, VOCs, etc. Thus, in order to isolate the effects attributable to the visitors, data regarding the outside/external conditions (i.e., conditions external to the environment) can be collected in step 102. By way of example only, the wireless sensor network can include motes outside of the environment that take readings of one or more of the above-mentioned quantities. These external factors can be accounted for when assessing the impact attributable to the visitors. For instance, as will be described below, when assessing the temperature variation and occupancy in a museum gallery it is preferable to control for the external temperature during the time period being analyzed.

Other useful data in accordance with the present techniques can include, for example, and the amount of air that is exhaled by visitors. This data can be used in an air mixing model to determine, for example, the likelihood of a patient inhaling bacteria from the visitors. See, for example, Fernstrom et al., "Aerobiology and Its Role in the Transmission of Infectious Diseases," Journal of Pathogens, Volume 2013, Article ID 493960, January 2013, 13 pages, the contents of which are incorporated by reference as if fully set forth herein.

In step 104, the data collected from the nodes is used to create risk maps indicating the impact the visitors will have on the environment. For instance, in a museum setting, based on the characteristics of the works of art in a particular gallery in the museum, and the data collected in step 102 regarding the presence and/or number of visitors in that gallery, the temperature, humidity, vibration, etc., an assessment of the risks to the works of art in that particular gallery can be quantified. It is assumed herein that a museum is made up of number of interconnected galleries, and that environmental conditions and/or visitor flow through each of the galleries can be individually regulated. To provide another example, in a hospital setting, risk models based on the data collected in step 102 (e.g., presence and/or number of visitors in a patient's room, biological/chemical contaminants, etc.) can be used to assess the risk to the patient. It is assumed herein that a hospital is a made up of a number of rooms (such as patient rooms where visitors might visit) and/or groupings of rooms in separate wing, ward, floor, etc., and that environmental conditions and/or visitor flow through each of the rooms or groupings of rooms can be individually regulated.

The risk maps will be application specific. Specifically, the risk maps created will take into account the specific environment in question. Take for instance, the example of a museum. The data collected and the risk models generated will take into account the art work within a particular gallery, its location on the wall, the air inlet and air outlet and the air stratification or mixing within the room and connection of the room with other rooms and the whole building. For instance, some artwork is more sensitive to changes in temperature, while others are affected more by changes in humidity. Thus, the risk maps created for each gallery in the museum will likely differ. Similarly, in a hospital setting the risk can vary depending on factors, such as the health/circumstances of treatment of the patient (e.g., patients having just undergone surgery might be more susceptible to airborne biological/chemical contaminants than those that are simply receiving diagnostic testing procedures). Thus, the risk maps created for each patient room or grouping of patient rooms in the hospital will likely differ.

As will be described in detail below, the risk maps may be created using computational fluid dynamics (CFD) for air flow and temperature and relative humidity distribution in the space and human body modeling that would assess exhaling and change in local temperature and relative humidity. The CFD analysis will provide insight into the airflow throughout the space (based, for example, on air entering and exiting the space via a ventilation system). The human body modeling will permit assessing the impact of the visitors on the indoor environment based on a person acting as an emission source of heat, moisture, $CO_2$, etc. Accordingly, it can be determined what amount of temperature, relative humidity, $CO_2$ level, etc. is attributable to the visitors.

Based on the risk models, in step 106 notifications or alerts can be generated whenever the risks exceed certain (predefined threshold) acceptable limits. For instance, an electronic message can be sent to managers of the museum, hospital, etc. notifying them that the risk in a particular region of the environment has exceeded an acceptable level. For instance, to use a museum setting as an example, if the temperature, humidity, etc. caused by the influx of visitors in one of the galleries exceeds a limit that is known to cause damage to the artwork in the gallery, then the museum management, staff, etc. can be sent a message, a page, etc. notifying them of the conditions and the particular gallery in question. In a hospital setting, when the number of visitors to a particular room, wing, floor, etc. causes the temperature, $CO_2$ levels, biological/chemical contaminants to exceed a limit that is likely to adversely affect the patients in that locale, then the hospital management, staff, etc. can be sent a message, page, etc. notifying them of the conditions and the particular are of the hospital in question.

According to an exemplary embodiment, the present techniques can be further implemented to estimate the likely travel path of the visitor in the indoor space. Estimating the travel path of visitors provides an opportunity to take preemptive action to counteract the affect the visitors can have on the indoor environment. For instance, using the example of a museum, if it can be determined in advance where visitors will likely head then corrective actions can be taken ahead of their arrival to protect the works of art in the various galleries along their path of travel. For instance, if it is determined that a large group of visitors might be heading in the direction of a particular gallery that contains temperature and/or humidity-sensitive works of art, then the air conditioning in that gallery might be increased in advance of the visitors' arrival, to aid in preventing damages to the works of art.

Thus, optionally, in step 108, the visitors' path of travel through the indoor space is estimated. Information that is useful in determining the visitors' path can be obtained in a number of different ways. To use the example of a museum, the visitors' interests can be used to determine their likely path through the galleries in the museum. Namely, it may be assumed that the visitors do not simply travel through the museum in a random fashion, but instead choose a path that that is based on the works/types of art that they want to see. This data regarding visitor preference can be obtained directly from the visitors, e.g., via an app on the visitor's mobile device, where the visitor specifies which works, types of art he/she is interested in. The museum might even provide visitors with a questionnaire (e.g., via a mobile app) through which the visitors can provide information about their preferences. The visitors might provide very specific information about their preferences such as the works of a particular artist(s), or only a general guidance, such as particular types of art (e.g., modern art). This information can be leverage based on the (known) layout of the museum to determine where the visitors most likely will head, and when. For instance, the layout of the galleries is known, as is the approximate distance between galleries, thus an estimate of when each visitor (at a known location) would arrive at each gallery can be determined. Based on the alert/notification (and optional projected path data), in step 110 actions can be implemented to reduce the risk. For instance, one measure that can be taken in step 110 to reduce the risk is to control the flow of visitors, such as by changing general visitor trends based on the risk maps where people may be rerouted or air conditioning system changed in advance to minimize the risk. For example, museum staff may temporarily close off a gallery to new visitors until existing visitors exit the gallery and the conditions in that gallery return to acceptable levels. Additionally, announcements can be made to the visitors (e.g., via a mobile application ("app")) directing them to other galleries in the museum to reduce the amount of visitor traffic through the gallery in question. Similarly, in a hospital setting, hospital staff can temporarily close off the respective area of the hospital to new visitors until the existing visitors exit that area of the hospital and conditions return to acceptable levels. Further, temperature and relative humidity in the hospital room can be adjusted to minimize exposure to pathogens and/or pressure in the room can be changed such that positive pressure will move air out of the room. For instance, pressure in a room can be changed by changing the airflow. For example, by increasing the air flow in a room, one can force the air to go from the room into the hallway. Additionally, by drawing air out of a room (e.g., through a vent) will bring air in from outside. As shown in FIG. 1, the process can be performed continuously to monitor visitor flow and conditions within the environment to, preferably in real-time, control the impact the visitors have on the environment.

Additionally, using the predicted path of visitors through the space, actions taken in step 110 might include preemptive actions to minimize the impact visitors have on the indoor environment. For instance, the air conditioning may be increased in a room/rooms in which an influx of visitors is expected. This will help counteract increases in temperature, humidity, potential pathogen transmission, etc. brought about by the increased number of visitors. The amount by which the temperature is increased can be simply based on the number of people expected to arrive, and when. In a museum for instance, if a school group signs in at the front desk, and is headed towards a particular gallery containing the art they are studying, then group size and the distance from the entrance to the gallery (to predict when they will arrive) can be used to predict by how much the temperature should be raised (e.g., x degrees per visitor). In the same manner, if a group of visitors signs in at the front desk at a hospital and asks for a particular patient's room, then the number of visitors and distance from the front desk to the given room can be used to estimate by how much and when the air conditioning should be increased in that patient's room.

A first exemplary embodiment is now described where the present techniques are used to manage visitor flow in a museum. As provided above, the presence of visitors in a museum can have an impact on the environment within the museum. Environmental fluctuations can affect works of art either by the intensity of the parameters (absolute magnitude) or by their fluctuation (rate of change). Depending on the works of art, different environmental conditions are needed to insure long term preservation (hundreds of years) of such objects. Given that visitors alter the environmental conditions in a given gallery in the museum, besides sensing the environment it is relevant to monitor visitors' whereabouts (further, predict them) and, in order to protect the works of art, be able to control visitors' flow between galleries in real-time. As provided above, visitors alter the environmental conditions by modifying the ambient temperature, relative humidity, and/or the organic chemicals vapors in a gallery. While some level of exposure to environmental fluctuations is acceptable, the fluctuations can be compounded by the number of visitors in a gallery and be such that could affect sensitive works of art. To use a simple example, assuming a given gallery is at the ideal environmental conditions for preserving the works of art therein. However, if a large influx of visitors enters the gallery, the resulting temperature impact would be significantly greater than if only one or two visitors entered the gallery.

Advantageously, as provided above, the present system is based on a dense wireless sensor network configured to measure environmental conditions and the number of people in a given space. These measurements, once obtained (e.g., as per step 102 of methodology 100—see above) and combined with the specific requirements of the artwork, permit the construction of risk models to assess the impact visitors have on environmental changes in museums (e.g., as per step 104 of methodology 100—see above). The system can then provide real-time information (e.g., alerts/notifications as per step 106 of methodology 100—see above) to museum operators and/or to devices that can be used to control the flow of people between galleries in a museum (e.g., as per step 108 of methodology 100—see above). The objective is that by controlling the visitors' flow, such impact on the museum environment can be maintained within certain predefined limits to protect the works of art. The present techniques assume a model of a human body, for example that it acts as an emission surface. The system can be easily extended, for example, to enable a mobile application to provide museum visitors with suggested paths to follow, which can be based on visitors' preferences, as well as the current desired outcome of the flow control system.

By way of example only, in the context of a museum—the dense wireless sensor network may contain sensors configured to measure the presence of people in a gallery (passive infrared) and the environmental variables related to long term preservation of works of art (transducers for temperature, relative humidity, volatile organic compounds, etc). The implementation of a wireless sensor network in a museum gallery in accordance with the present techniques is depicted, for example, in FIG. 2—described below. In a museum, the main concerns for works or art are: lighting, volatile organic compounds (VOCs) off gassing, airborne pollutants, temperature, humidity, shocks, and vibrations.

The nodes (also commonly referred to as "motes") in a wireless sensor network (WSN) are small, energy efficient devices, powered by batteries, and forming a mesh network. The motes are fitted with sensors and are densely distributed throughout the museum. According to an exemplary embodiment, the sensors in each node in the WSN include temperature and relative humidity sensors for climate measurements. For air quality measurements, each mote has sensors configured to quantify the $CO_2$ and/or VOC levels in the air. Also, each mote is equipped with passive infrared (IR) sensors which are used to detect the presence of people and/or count the number of people in a gallery. For instance, IR sensors detect movement. Hence, IR sensors can be used to detect the presence of visitors in a gallery based on their movement. Further, since the IR sensors are at fixed positions (within a gallery) they can be used to count the number of people (visitors) that pass by in front of the sensor. RF signal source and receptor can be installed, and from the change in the reflected signal (i.e., from receptor back to the source) the number of people can be calculated. For example, when people pass between the RF signal source and the receptor they break the beam. The number of times the beam is broken can be used to determine the number of visitors that have passed by that point in the room. Furthermore, the presence and/or number of visitors can be ascertained by tracking the signal from cell phones or from mobile devices in the galleries and/or by detecting the numbers of apps used as visitors are guided through gallery using mobile guidance.

Figure 2:
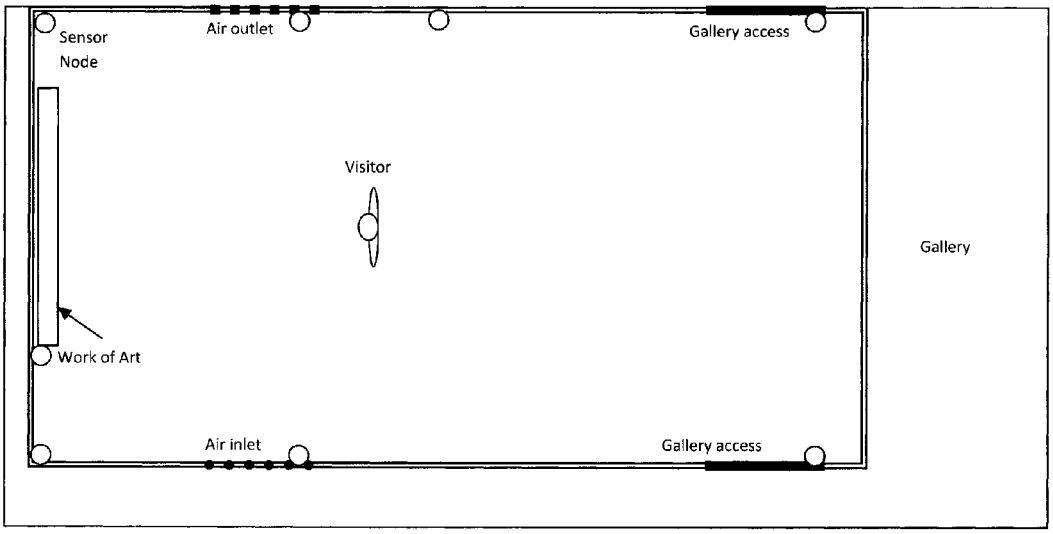
FIG. 2 is a schematic diagram illustrating the placement of the sensors (as part of a wireless sensor network (WSN)) in an indoor space such as a gallery of a museum according to an embodiment of the present invention.

FIG. 2 is a schematic diagram illustrating the placement of the sensors (as part of a WSN) in a gallery of a museum. Data can be obtained from the sensors relating to the presence of visitors in the gallery and the level of impact the visitors have on the environmental conditions in the gallery (see, for example, step 102 of FIG. 1). FIG. 2 provides a top-down view of the room (gallery). While this example focuses on a museum gallery setting, the concepts are more generally applicable to any other indoor setting where the movement of visitors and effect thereof on the environment is analyzed. For instance, see the example below where the present techniques are implemented in a hospital setting.

As highlighted above, a focus of the present techniques is to be able to assess and regulate/manage the impact visitors have on the environment. In this example, the environment (a gallery) contains a work of art. A visitor is shown in the gallery. The presence of the visitor will affect the conditions in the gallery, such as temperature, $CO_2$ levels, vibration, etc.—see above. In order to monitor and analyze the visitor's impact on the environment, sensors are located throughout the gallery. See FIG. 2. In this example, sensors are located near the work of art, at air inlet and air outlet points, at points of entrance into the gallery, and in various other positions throughout the gallery. By way of example only, the sensors at the air inlets and air outlets to the gallery can measure (in addition to other conditions) the temperature, humidity, etc. of the air entering and exiting the gallery. Namely, in this case, a ventilation system is configured to deliver (air conditioned) air to the gallery through vents (labeled "air inlet"). Warm air is removed from the gallery through other vents (labeled "air outlet") and returned to air conditioning units via the ventilation system. The air conditioning units can be adjusted to supply air at a set temperature. Thus, by measuring the difference between the inlet and outlet temperatures (via the sensors), one can get an estimate of the impact visitors are having on the temperature of the environment. The same applies for other quantities such as humidity, $CO_2$ levels, etc.

The sensors at the access points to the gallery can measure/detect (in addition to other conditions) the presence and/or number of visitors in the gallery. For instance, if these sensors include passive infrared sensors, then whenever a visitor accesses the gallery and passes in front of the sensor, that event can be recorded. Thus, a total number of visitors in the gallery that have entered through the gallery access can be measured. Further, if the flow of visitors is regulated, such that one of the gallery access points is designated as an entrance, and the other an exit, then real-time measurements of the number of visitors in the gallery can be easily obtained by noting the number of visitors accessing the gallery through the entrance, less the number of visitors that have exited the gallery during that same time period. To give a simple illustrative example, say for instance, that at a given point in time, there are no visitors in the gallery (i.e., the infrared sensors do not detect any movement inside the gallery. However, in the next five minute interval, 10 people pass by the sensor(s) at the entrance to the gallery and during that same time interval 5 people pass by the sensor(s) at the exit to the gallery. Then it may be assumed that 5 people are presently in the gallery.

While FIG. 2 depicts the sensors present in a particular gallery in the museum, it is preferable to employ a network of sensors throughout the museum, i.e., in every gallery of the museum, for taking real-time measurements of the activity/conditions therein. The use of dense spatial and temporal monitoring on every gallery in a museum allows for the generation of detailed microclimate models of such spaces via computational fluid dynamic methods—see below. Furthermore the sensor network can track people moving through the galleries and be able to calibrate predictions based on art preference and cultural semantics.

Figure 3:
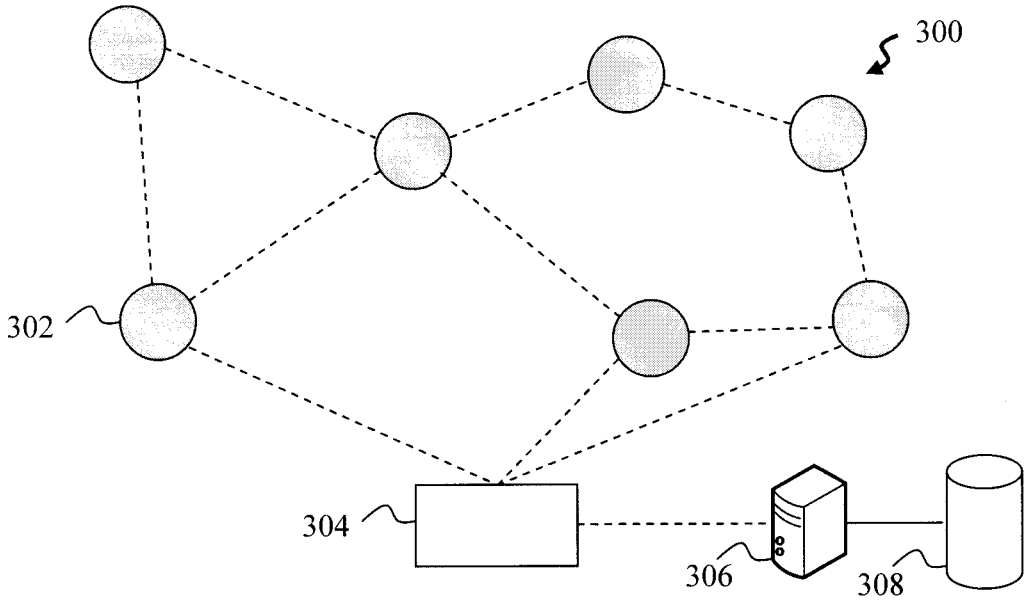
FIG. 3 is a schematic diagram of WSN according to an embodiment of the present invention.

A schematic diagram of a WSN 300 is shown in FIG. 3. As shown in FIG. 3, WSN 300 includes an array of interconnected nodes 302. Namely, each node can communicate wirelessly with one or more other nodes and/or with a gateway 304. Thus, the nodes 302 can convey data to the gateway 304 either directly or via one or more other nodes 302. The gateway 304 coordinates the nodes in the wireless sensor network and it also relays the data to a central server 306 for further processing. WSN gateways are commercially available and the details for implementing a gateway to aggregated data from the nodes in a WSN, relay the data to a central sever, etc. are known in the art. Since the environmental fluctuations of interest can include the absolute magnitude of the parameter or their change of rate, historical data is preferably stored in a database 308.

WSN 300 is generally applicable to the various embodiments provided herein for regulating visitor flow in an indoor environment, such as a museum, hospital, etc. Thus, central server 306 can be used to execute the steps of methodology 100 (see above) and/or any of the other processes described herein (see, for example, the analysis algorithms provided below), either in real-time or on demand. As detailed above, the outcome of the analysis is used to create risk maps or notifications for museum operators. The server could also provide information to a mobile app to guide museum visitors to certain galleries.

Figure 4:
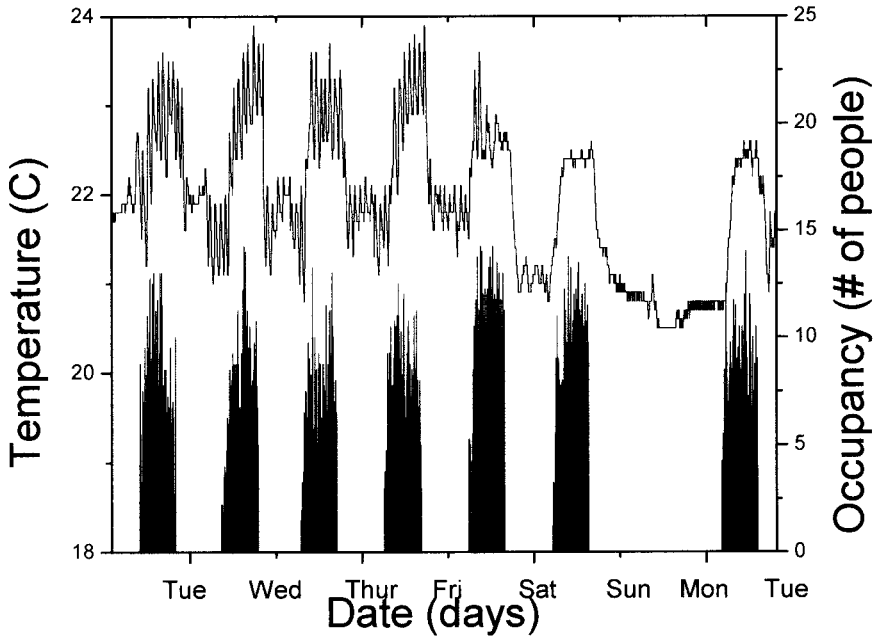
FIG. 4 is a diagram illustrating temperature variation and occupancy in a museum gallery, controlling for external temperature according to an embodiment of the present invention.

Besides the number of visitors, changes to the indoor environment can also be due to other factors like the season of the year which can affect air quality (e.g., VOC, $CO_2$). FIG. 4 is a diagram illustrating temperature variations as a function of the number of visitors in a museum gallery during a week. The data was sensed using the present wireless sensor network. The chart quantifies the change in temperature within the gallery as the number of visitors is increasing. For the location each person's presence resulted in a 0.1° C. change in the temperature. As shown in FIG. 4, temperature (measured in degrees Celsius (° C.)) is plotted on one axis and occupancy (based on the number of people) on the other. The top curve in the figure represents the temperature measurements and the bottom curves represent the occupancy. For each day of the week plotted, there is a strong correlation between the number of people in the gallery and a spike in the temperature.

The data collected from the WSN is then used to create risk models (see, for example, step 104 of FIG. 1, above) which can be used to assess the impact the visitors will have on the environment within the gallery. As provided above, the risk models created will take into account the specific environment in question. This makes sense since the risks will change depending on the artwork present in the gallery. For instance, certain pieces may be more susceptible to damage due to fluctuations in temperature, while other works may be more greatly affected by changes in humidity. These environmental factors may be impacted differently by the number of visitors. Say for instance, that the impact of a given number of visitors impacts the temperature in the gallery greater than it does the humidity. Then, in that case, the level of risk would be greater if temperature-sensitive works were housed in the gallery than if humidity-sensitive works were present. A different scenario would exist if both types of works were present in the same gallery, and so on.

Figure 5:
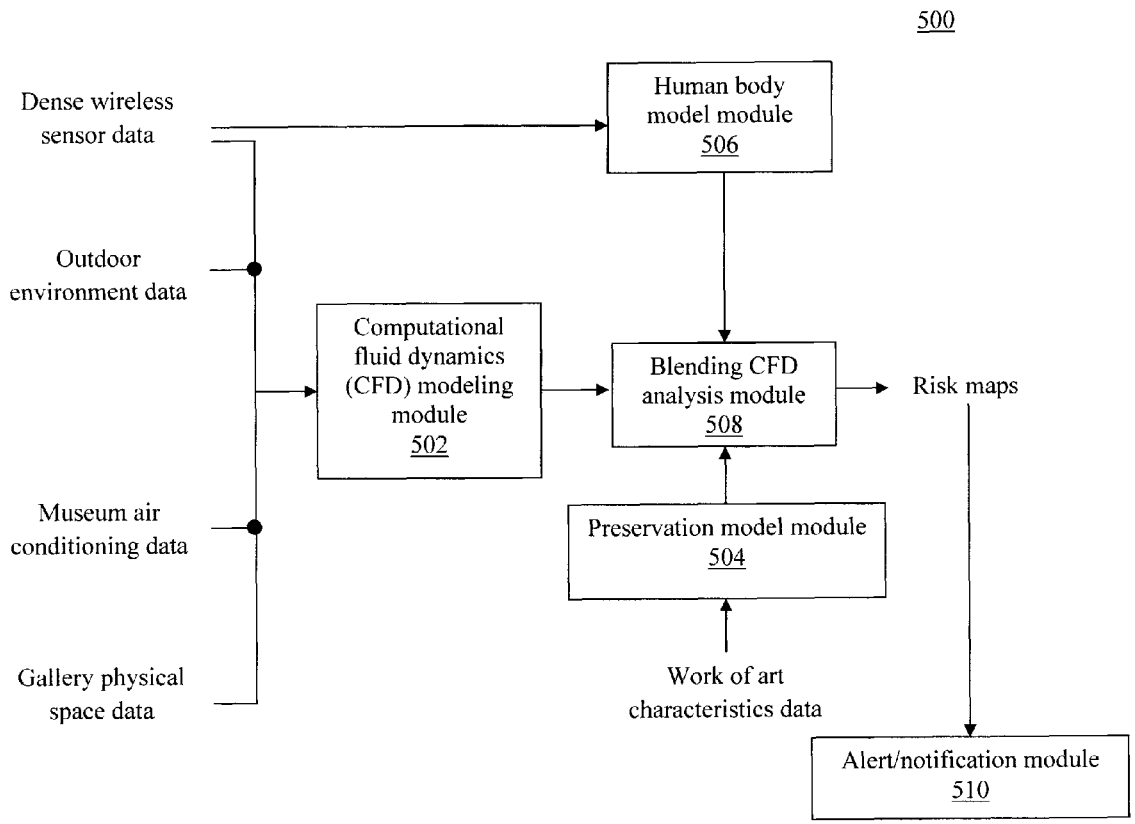
FIG. 5 is a diagram illustrating an exemplary system for managing visitor flow in a museum gallery according to an embodiment of the present invention.

FIG. 5 is a diagram illustrating an exemplary system 500 for managing visitor flow in a museum gallery in accordance with the present techniques, which takes into account the characteristics of the specific works of art contained in the gallery. System 500 may be implemented in performing the steps of methodology 100 (of FIG. 1) in a museum gallery setting. System 500 may be embodied on an apparatus such as apparatus 700 of FIG. 7.

In this example, computational fluid dynamics (CFD) analysis is used to model the environmental conditions in the gallery which when combined with preservation models for the particular works of art in the gallery and human body models (relating to the presence/number of visitors in the gallery) can be used to assess the risk levels. As is known in the art, computational fluid dynamics is a tool used to predict air flow in a space (in this case a gallery in the museum) using mathematical modeling. For instance, computational fluid dynamics can be used to solve the Navier-Stokes (NS) equations (i.e., NS-CFD) for use in managing heat flow domains, such as data centers. See, for example, U.S. Pat. No. 8,306,794 issued to Hamann et al., entitled "Techniques for Thermal Modeling of Data Centers to Improve Energy Efficiency" (hereinafter "U.S. Pat. No. 8,306,794"), the contents of which are incorporated by reference as if fully set forth herein, which describes creating a NS-CFD model using data collected from a sensor network. See also, Y. Amemiya et al., "Comparison of Experimental Temperature Results with Numerical Modeling Predictions of a Real-World Compact Data Center Facility," Proceedings of IPACK2007 ASME InterPACK '07 (July 2007), the contents of which are incorporated by reference as if fully set forth herein.

In system 500, the CFD modeling is carried out by a CFD modeling module 502. As shown in FIG. 5, one input to the CFD model is the data obtained from the WSN (labeled "Dense sensor wireless data"). As described in detail above, the present WSN can be used to collect environmental data from the gallery space, such as temperature, relative humidity, $CO_2$ levels, VOCs, motion (i.e., vibration), airborne biological and/or chemical matter, light intensity, etc. In system 500 this data is obtained by the CFD modeling module 502. As also provided above, the conditions outside of the gallery can be taken into consideration when assessing the impact visitors have on the environment (see, for instance, the example provided in FIG. 4 where accounts are made for external temperatures). As noted above, the WSN may include nodes present outside of the gallery to collect this external data. Alternatively (or in addition to these external nodes), data relating to the external conditions may be obtained from other sources, such as a national weather service that may be accessed via the Internet. In system 500 this data (labeled "Outdoor environment data") is also relayed to the CFD modeling module 502.

To create a CFD model for the gallery, layout data for the domain is also needed. See for example, U.S. Pat. No. 8,306,794. By way of example only, this layout data (labeled "Gallery physical space data") can include the physical dimensions of the gallery, the location of air conditioning vents (air inlets and air outlets—see FIG. 2), etc. In system 500 this data is also relayed to the CFD modeling module 502.

Finally, data relating to the air conditioning system in the museum (labeled "Museum air conditioning data") is also collected for the CFD analysis. By way of example only, this data can include the set temperature for the respective air conditioning unit(s), the temperature at the air inlets and air outlets, etc. As provided above, the WSN can be used to collect air inlet and air outlet temperatures. In system 500 this air conditioning data is also relayed to the CFD modeling module 502.

From all of the collected data (i.e., dense wireless sensor data, outdoor environment data, museum air conditioning data, gallery physical space data, etc.), the CFD modeling module 502 will create a rapid CFD model for the gallery. In a rapid CFD model, one may not have to solve the whole differential equation but rather use some scaling relationships between air temperature change and number of visitors. This relationship can then be used to solve the air circulation based on well established proxies and can speed up the modeling by a factor of 10. Since the number of visitors in a museum gallery is constantly changing, the CFD model needs to be continuously updated to account for changing conditions in real-time using the collected data.

As provided above, it is possible to also take into account the probably path visitors will take through the museum. That way, actions can be taken to preemptively counteract the effects the visitors will have on the indoor environment. For instance, the air conditioning can be preemptively raised to compensate for an increase in temperature and/or humidity resulting from an imminent influx of visitors into a particular gallery. In that case, it would be desirable to combine the CFD model with predicted travel path for each visitor to assess when how they are moving through the galleries and where is likely that they will stop. For example, if the CFD model indicates that temperature change will be for example 0.5 degree for 10 visitors but the acceptable threshold will be just 0.15 degree, then you can have 5 visitors allowed on a certain path and the other 5 diverted on a different path.

In order to assess the risks to the particular works housed in the gallery, one must next account for the specific characteristics of those works of art, i.e., the work of art's reaction to environmental conditions variations. According to an exemplary embodiment, this is done through the use of preservation models created via a preservation model module 504 of system 500. The preservation model module 504 leverages available data relating to the specific characteristics for different works of art and models that data to the specific pieces in the gallery.

Data relating to the characteristics of different works of art (labeled "Work of art characteristics data") may be obtained, for example, from sources such as the Scientific and Conservation Department of the National Gallery in London which provides information relating to the proper moisture content of the air/relative humidity, UV light, temperature, etc. for different types of art, which is based on the research of the degradation of objects of art. For example, paintings get damaged faster by having excessively high or low or rapidly changing relative humidity levels in their environment. On the other hand, wood objects, like panels and canvas, are mostly affected by only the fast changes in relative humidity, which can cause warping of the wood. In system 500 this data is relayed to the preservation model module 504. The preservation model module 504 will take this data and create a preservation model for the works of art in that particular gallery. By way of example only, the model might simply include the works of art in the gallery and a range of acceptable environmental parameters. For instance, the model might set absolute temperature and/or humidity limits and/or specifications for fluctuations of these parameters—all based on the particular works contained in the gallery.

In assessing the impact visitors have on the environment, one must have a way to quantify the human presence in the gallery. According to an exemplary embodiment, a human body model is utilized where it is assumed to act as an emission surface. As is known in the art, the human body emits energy, e.g., as infrared light. The amount of heat radiated from a person can be calculated, for example, using the Stefan-Boltzmann law, $Q=e\sigma AtT^4$, wherein e is an object's emissivity, $\sigma$ is the Stefan-Boltzmann constant $5.67\times10^{-8}$ J/s·m$^2$·K$^4$, A is the radiating area, t is time, and T is the temperature in Kelvin. An adult has an estimated total surface area of about 2 square meters (m$^2$), a surface temperature of about 33° C., and an emissivity of about 0.98. Thus, the heat radiated from a person/visitor can be calculated. According to an exemplary embodiment, this is done via a human body model module 506 of system 500. To calculate the impact of the current number of visitors in the gallery, the human body model module 506 receives data from the WSN. See FIG. 5. Namely, as provided above, the WSN can be configured to ascertain both the presence and the number of visitors in the gallery. Thus based on the number of people detected by the WSN, the human body model module will be able to determine the total amount of thermal radiation attributable to the visitors.

In addition to thermal impact, the human body model module 506 further accounts for moisture (humidity), $CO_2$ emissions, etc. attributable to visitors. These emissions are mainly due to the evaporative cooling and respiration mechanisms of the body of a person. For instance, on average a person produces between about 0.2 pounds to about 0.6 pounds of water per hour due to perspiration and respiration and, through the natural process of breathing, about 2.3 pounds of $CO_2$ per day.

The output from the CFD modeling module 502, the preservation model module 504, and the human body model module 506 are provided to a blending CFD analysis module 508. See FIG. 5. The blending CFD analysis module 508 will take into account the CFD model from module 502 the preservation model from module 504, the human body model from module 506 and produce a risk map. As is known in the art, blending CFD analysis involves solving physical models to assess how temperature and air flow changes in a room. These models will take into account the amount of air that is exchanged in the room and will assess for how long the visitor impact will linger in the room. For example, for a wood object it is understood that changes in relative humidity will affect the object if the humidity change occurs for longer than 45 minutes as moisture needs to penetrate through the wood fiber to create an impact. This will require that humidity near the object will stay unchanged or, in case it is varying, will have a larger change at the beginning and then gradually decrease (i.e., the response may not be linear, e.g., at the beginning the surface will absorb moisture and will create a change—following the initial change, the moisture needs to diffuse through the wood and that is a very slow process as it has to travel through the wood fiber, and if the humidity at the surface decreases the diffusion stops and may revert in direction). In both cases the wood object will increase in volume due to absorbed moisture and if there are cracks or defects they will increase in size. Repetitive exposure will create a permanent damage that will increase in size and shape as wood is exposed to humidity fluctuations.

As is known in the art, a risk map is a tool used to visualize the risk an organization, individual, etc. faces. For a description of risk maps and modeling see, for example, U.S. Pat. No. 8,844,029 issued to Hiroshi Sakaki, entitled "Risk Model Correcting System, Risk Model Correcting Method, and Risk Model Correcting Program" (hereinafter "U.S. Pat. No. 8,844,029"), the contents of which are incorporated by reference as if fully set forth herein. As provided in U.S. Pat. No. 8,844,029, a risk model can include a relationship between a threat and a vulnerability and their weights. A common representation used is that of a heat map. Heat maps graphically represent data using colors for individual values. Heat maps, and use thereof for diagnostic monitoring are described, for example, in U.S. Pat. No. 8,437,984 issued to McGreevy et al., entitled "Visualization Employing Heat Maps to Convey Quality, Prognostics, or Diagnostics Information," the contents of which are incorporated by reference as if fully set forth herein. The risk map may also be represented as a humidity map or number of pathogens in the air. For example, the wireless sensor measurement plus the CFD model creates a three-dimensional representation of the temperature distribution in a room or gallery. If the amount of moisture is fixed as it is the case of a sealed building, higher temperature means more moisture in that location. Once the temperature is known, a humidity map can be created. Pathogens will stick to surfaces faster if they are in a higher humidity environment. The relationship between humidity and temperature is described, for example, in Lawrence, "The Relationship between Relative Humidity and the Dewpoint Temperature in Moist Air, A Simple Conversion and Applications," American Meteorological Society, pgs. 225-233 (February 2005), the contents of which are incorporated by reference as if fully set forth herein. The building can then be sliced at different heights, and that will create a map of location versus humidity.

Based on the risk map, as provided above, alerts or notifications can be generated and/or actions can be taken to reduce the risk by controlling the temperature or relative humidity changes to not exceed levels where irreversible changes may occur. These levels need to be determined for each object individually or extracted from published literature where sensitivity models are established. Currently databases exist where changes to art objects have been documented and similar responses are assumed for objects manufactured from the same materials and from the same historical period. In system 500, these alerts/notifications are generated by the alert/notification module 510. By way of example only, if the risk map indicates that the risk of damage to the artworks in the gallery is unacceptably high given the environmental conditions and the number of visitors, then an alert (e.g., via electronic message) can be sent to museum staff who can then take appropriate action—such as regulating the number of visitors, adjusting the hospital air conditioning system, etc.

By providing real time feedback to museum staff about the galleries' climate conditions and occupancy trends, preventive actions can be taken, e.g., temporarily close a gallery, to avoid potential hazards and critical conditions that may damage the art. In summary, possible actions to alleviate the risks of damaging works of art by visitors include, but are not limited to, limiting the number of visitors, limiting their duration of stay, persuading visitors to go to other galleries, or compensating the microclimate effects with the museum air conditioning system.

Also, system 500 can be directly coupled with a ventilation or heating system that controls air flow and adjusts temperature and relative humidity such that risk is reduced. These changes could be a permanent change as long as a visitor is present in the room or applying the changes in small pulses such that adjustment is maintained around the threshold level that indicate increased risk.

Another exemplary embodiment is now described where the present techniques are used to manage visitor flow in a hospital or other health care facility. As provided above, visitors to a hospital can alter the chemical and biological content of the air and/or cause unstable environmental conditions (such as changes to the temperature, relative humidity, volatile organic compounds (VOCs) etc.)—all of which can increase the risk of disease transmission (e.g., infectious disease and/or bacteria/chemicals that are associated with human body can lead to risk of exposure to diseases or chemicals for patients in hospitals). In one approach, the number of visitors can be estimated by providing a visitor badge for each person that has an embedded radio frequency (RF) ID tag. Periodically the RFID tags are read and proximity is determined by the signal strength providing a distribution of all the people in the hospital. The risk (amount of temperature and humidity change or the number of viruses) scales with the number of visitors that are entering the facilities and the length of their time spent there.

In the same manner as described above, data is obtained from a WSN relating to the presence of visitors in the environment (in this case a hospital) and the changes associated with the visitors' presence in the environment (e.g., as per step 102 of methodology 100—see above). Namely, a dense wireless sensor network with sensors (see, for example, FIG. 3—described above) positioned in key locations can assess the impact of visitors, through monitoring, for example, $CO_2$, VOC, pH changes. In this case, the sensors can be located near patients and/or in their rooms. The present model assumes that a human body acts as an emission surface area and human respiration will have a number of pathogens that have a probability to be deposited on surfaces or being inhaled by other people. As the number of exchanged molecules increases, the risk of exposure will increase. Form this data, real time analytics can be used to create risk maps that detail the risk of exposure (e.g., as per step 104 of methodology 100—see above). Based on the risk maps, alerts or notifications can be generated (as per step 106 of methodology 100—see above) and/or actions can be taken to reduce the risk (as per step 108 of methodology 100—see above)—such as (1) limiting time of visit, (2) limiting number of people in a room, and/or (3) dynamically adjusting the air exchange in a room such that safety levels are maintained.

For instance, by regulating the number of visitors to a patient's room and/or the amount of time they spend there, the potential for the transmission of pathogens from the visitors to the patient can be reduced. The present techniques take into account the particulars of the patient in order to better ascertain the risk of pathogen exposure. For instance, factors such as the patient's age, overall health, etc. can factor into the risk of contracting an illness from contact with others. Thus, thus the number of visitors may be reduced for a patient that is at a greater risk for infection. A risk map may be created for each patient room in the hospital to properly address the risks to the particular patient(s) in that room by the flow of visitors.

Further, as provided above, temperature fluctuations in an indoor environment can be directly correlated with the presence and number of visitors (see, e.g., FIG. 4—described above). The same holds true for the various rooms in a hospital, such as patients' rooms. In the hospital setting, unstable environmental conditions, such as fluctuations in temperature, can lead to increased infection rates. See, for example, Lowen et al., "Roles of Humidity and Temperature in Shaping Influenza Seasonality," Journal of Virology, vol. 88, no. 14 7692-7695 (July 2014) (hereinafter "Lowen"), the contents of which are incorporated by reference herein. For instance, according to Lowen, variations in temperature and relative humidity can lead to influenza outbreaks. See also, Yang et al., "Dynamics of Airborne Influenza A Viruses Indoors and Dependence on Humidity," PLoS ONE 6(6): e21481 (June 2011); and Tang, "The effect of environmental parameters on the survival of airborne infectious agents," J. R. Soc. Interface (September 2009) 6, 5737-5746, the contents of both of which are incorporated by reference as if fully set forth herein. As provided above, due to the evaporative cooling and respiration mechanisms of the body of a person, humans emit heat, moisture, $CO_2$, etc. Thus the presence of visitors in a hospital room can affect the temperature, moisture (relative humidity), $CO_2$ levels in the room, and that effect scales with the number of visitors.

Figure 6:
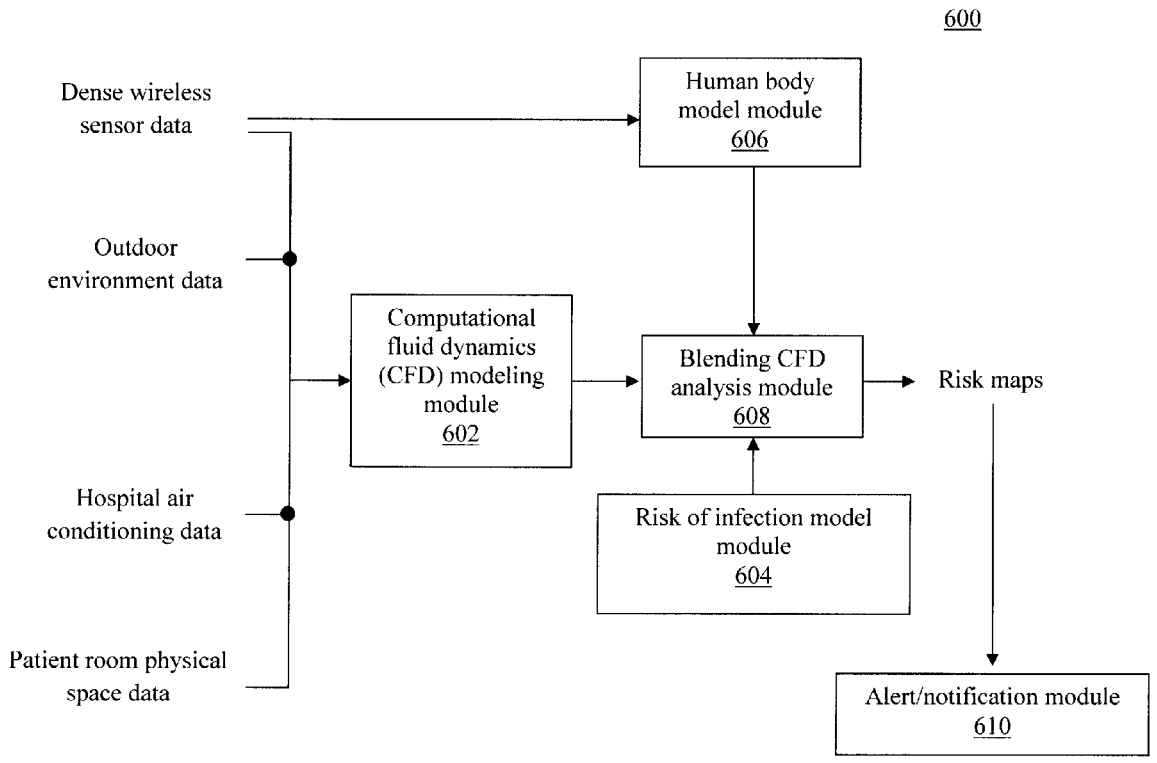
FIG. 6 is a diagram illustrating an exemplary system for managing visitor flow in rooms in a hospital according to an embodiment of the present invention.

FIG. 6 is a diagram illustrating an exemplary system 600 managing visitor flow in rooms in a hospital in accordance with the present techniques, which takes into account the risk of infection for patients in the rooms. System 600 may be implemented in performing the steps of methodology 100 (of FIG. 1) in a hospital patient room setting. System 600 may be embodied on an apparatus such as apparatus 700 of FIG. 7.

In this example, CFD air flow analysis is used to model the environmental conditions in the rooms which when combined with risk of infection models for the patients and human body models (relating to the presence/number of visitors in the room) can be used to assess the risk levels.

In system 600, the CFD modeling is carried out by CFD modeling module 602. As shown in FIG. 6, one input to the CFD model is the data obtained from the WSN (labeled "Dense sensor wireless data"). As described in detail above, the present WSN can be used to collect environmental data from the room, such as temperature, relative humidity, $CO_2$ levels, VOCs, motion (i.e., vibration), airborne biological and/or chemical matter, light intensity, etc. In system 600 this data is obtained by the CFD modeling module 602. As also provided above, the external conditions can be taken into account when assessing the impact visitors have on the environment. As noted above, the WSN may include nodes present outside of the room to collect this external data. Alternatively (or in addition to these external nodes), data relating to the external conditions may be obtained from other sources, such as a national weather service that may be accessed via the Internet. In system 600 this data (labeled "Outdoor environment data") is also relayed to the CFD modeling module 602.

To create a CFD model for the room, layout data for the domain is also needed. This layout data (labeled "Patient room physical space data") can include the physical dimensions of a patient room, the location of air conditioning vents in the room, etc. Like in the previous example, it is assumed here that the hospital employs an air conditioning system that delivers cooled air to the patient rooms via a first set of vents (i.e., air inlets) and removes warmed air from the rooms via another set of vents (i.e., air outlets). In system 600 this layout data is also relayed to the CFD modeling module 602.

Finally, data relating to the air conditioning system in the hospital (labeled "Hospital air conditioning data") is also collected for the CFD analysis. By way of example only, this data can include the set temperature for the respective air conditioning unit(s), the temperature at the air inlets and air outlets, etc. As provided above, the WSN can be used to collect air inlet and air outlet temperatures. In system 600 this air conditioning data is also relayed to the CFD modeling module 602.

From all of the collected data (i.e., dense wireless sensor data, outdoor environment data, hospital air conditioning data, patient room physical space data, etc.), the CFD modeling module 602 will create a CFD model for the room. Next, in order to assess the risks to the particular patients in the rooms, one must take into account these patients' risks for infection, i.e., how susceptible the patients are to contracting a pathogen from visitors. This assessment can be made based on an individual patient's medical records and known susceptibility trends. According to an exemplary embodiment, this is done through the use of risk of infection models created via a risk of infection model module 604 of system 600. The risk of infection model module 604 leverages data from patients' medical records and available data relating to susceptibility trends for common pathogens.

By way of example only, historical data is available from the Centers for Disease Control and Prevention (CDC) relating to pneumonia and influenza mortality rates for cities in the U.S. From this data, patient characteristics such as age, gender, etc. can be assessed against the mortality rates to create a model for risk of infection. From this model, one can assess how different age or gender groups are associated with risk of exposure. In system 600 this data is relayed to the risk of infection model module 604. The risk of infection model module 604 will take this data and create a risk of infection model for the patient(s) in particular rooms in the hospital. By way of example only, the model might simply include a range of acceptable numbers of visitors and/or environmental parameters affecting disease transmission for those patients. For instance, the model might set absolute numbers of visitors and/or the duration of their visits, and/or temperature, humidity limits, etc.—all based on the risk of infection for those patients. To give a simple example, if patients in age range x-y are at greater risk of contracting influenza from visitors than patients in the age range y-z, then the limit on the number of visitors to the rooms of patients in the age range x-y can be set lower than that for patients in the age range y-z. Data regarding human-to-human transmission of flu-causing viruses, also available from the CDC, can be leveraged to set these limits.

In the same manner as described above, a human body model (wherein the human body acts as an emission surface) can be utilized to assess the impact the visitors will have on the environment. Namely, as provided above, the amount of heat radiated from a person can be calculated, for example, using the Stefan-Boltzmann law, $Q=e\sigma AtT^4$, wherein e is an object's emissivity, σ is the Stefan-Boltzmann constant $5.67\times10^{-8}$ $J/s\cdot m^2\cdot K^4$, A is the radiating area, t is time, and T is the temperature in Kelvin. An adult has an estimated total surface area of about 2 square meters ($m^2$), a surface temperature of about 33° C., and an emissivity of about 0.98. As also provided above, a person produces between about 0.2 pounds to about 0.6 pounds of water per hour due to perspiration and respiration and, through the natural process of breathing, about 2.3 pounds of $CO_2$ per day.

According to an exemplary embodiment, these calculations are made via a human body model module 606 of system 600. To calculate the impact of the current number of visitors in a patient's room (i.e., in real-time), the human body model module 606 receives data from the WSN. See FIG. 6. Namely, as provided above, the WSN can be configured to ascertain both the presence and the number of visitors in the room. Thus based on the number of people detected by the WSN, the human body model module will be able to determine the total amount of thermal radiation, relative humidity, $CO_2$ levels, etc. attributable to the visitors.

The output from the CFD modeling module 602, the risk of infection model module 604, and the human body model module 606 are provided to a blending CFD analysis module 608. See FIG. 6. The blending CFD analysis module 608 will take into account the CFD model from module 602 the risk of infection model from module 604, the human body model from module 606 and produce a risk map. The details of the blending CFD analysis were provided above. Also, as provided above, a common exemplary representation of a risk map is as a heat map which uses colors to represent individual risk values.

Based on the risk map, as provided above, alerts or notifications can be generated and/or actions can be taken to reduce the risk. In system 600, these alerts/notifications are generated by the alert/notification module 610. By way of example only, if the risk map indicates that the level of risk to the patient(s) in the room is unacceptably high given the environmental conditions and the number of visitors, then an alert (e.g., via electronic message) can be sent to hospital staff who can then take appropriate action—such as regulating the number of visitors, adjust the hospital air conditioning system, etc.

By providing real time feedback to hospital staff about the climate conditions and occupancy trends in the patients' rooms, preventive actions can be taken, e.g., temporarily close off a room, floor, wing of the hospital, etc. to new visitors, to avoid potential hazards and critical conditions that may unacceptably increase infection risks. In summary, possible actions to alleviate infection risks due to the presence of visitors include, but are not limited to, limiting the number of visitors, limiting their duration of stay, or compensating the microclimate effects via the hospital air conditioning system (such as when environmental conditions like temperature and relative humidity present an unacceptable level of risk for disease transmission to the patient—see above). Also, system 600 can be directly coupled with a ventilation or heating system that controls air flow and adjusts temperature and relative humidity such that risk is reduced. These changes could be a permanent change as long as a visitor is present in the room or applying the changes in small pulses such that adjustment is maintained around the threshold level that indicate increased risk.

Further, the data collected via the present techniques can be aggregated at the hospital level to create a real-time map of potential pathogen exposure throughout the hospital. Additionally preventive action can be taken, like turning on UV light to neutralize the bacteria or sanitizer dispensed in the air to neutralize the pathogens.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Figure 7:
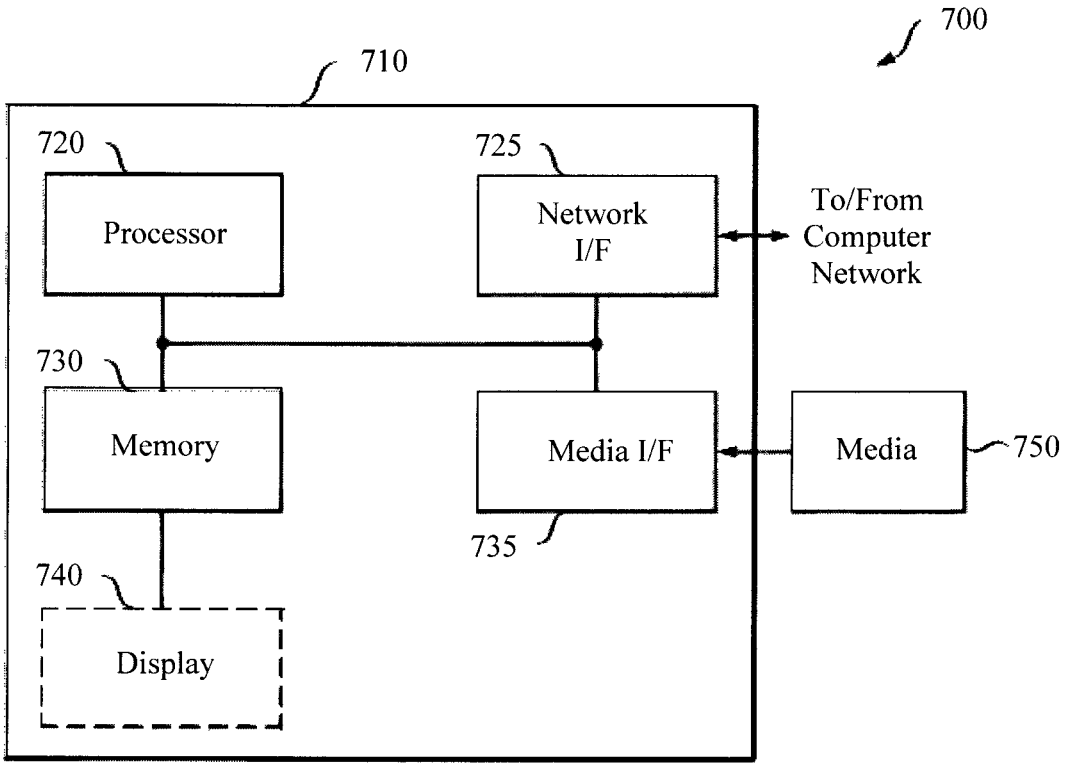
FIG. 7 is a diagram illustrating an exemplary apparatus for performing one or more of the methodologies presented herein according to an embodiment of the present invention.

Turning now to FIG. 7, a block diagram is shown of an apparatus 700 for implementing one or more of the methodologies presented herein. By way of example only, apparatus 700 can be configured to implement one or more of the steps of methodology 100 of FIG. 1.

Apparatus 700 includes a computer system 710 and removable media 750. Computer system 710 includes a processor device 720, a network interface 725, a memory 730, a media interface 735 and an optional display 740. Network interface 725 allows computer system 710 to connect to a network, while media interface 735 allows computer system 710 to interact with media, such as a hard drive or removable media 750.

Processor device 720 can be configured to implement the methods, steps, and functions disclosed herein. The memory 730 could be distributed or local and the processor device 720 could be distributed or singular. The memory 730 could be implemented as an electrical, magnetic or optical memory, or any combination of these or other types of storage devices. Moreover, the term "memory" should be construed broadly enough to encompass any information able to be read from, or written to, an address in the addressable space accessed by processor device 720. With this definition, information on a network, accessible through network interface 725, is still within memory 730 because the processor device 720 can retrieve the information from the network. It should be noted that each distributed processor that makes up processor device 720 generally contains its own addressable memory space. It should also be noted that some or all of computer system 710 can be incorporated into an application-specific or general-use integrated circuit.

Optional display 740 is any type of display suitable for interacting with a human user of apparatus 700. Generally, display 740 is a computer monitor or other similar display.

Although illustrative embodiments of the present invention have been described herein, it is to be understood that the invention is not limited to those precise embodiments, and that various other changes and modifications may be made by one skilled in the art without departing from the scope of the invention.

What is claimed is:

1. A method for managing visitor flow in an indoor space, the method being embodied in instructions that, when executed by a processor device, cause the processor device to implement the steps of:

obtaining real-time data from a wireless sensor network present in the indoor space by the processor device, wherein the real-time data indicates a presence and a number of visitors in the indoor space and one or more environmental conditions in the indoor space;

creating a risk map using the real-time data, wherein the risk map indicates an impact the presence and the number of visitors have on the environmental conditions in the indoor space; and generating an alert by the processor device whenever the risk map indicates that the presence and the number of visitors have greater than a predefined threshold impact on the environmental conditions in the indoor space.

2. The method of claim 1, wherein the wireless sensor network comprises one or more of: temperature sensors, relative humidity sensors, carbon dioxide ($CO_2$) level sensors, volatile organic component (VOC) level sensors, airborne biological matter sensors, airborne chemical matter sensors, and light intensity sensors configured to measure the environmental conditions in the indoor space.

3. The method of claim 1, wherein the wireless sensor network comprises passive infrared sensors or RF radios to detect the presence and the number of visitors in the indoor space.

4. The method of claim 1, wherein the risk map comprises a heat map.

5. The method of claim 1, further comprising the step of:

regulating the visitor flow in the indoor space based on the alert.

6. The method of claim 1, wherein the indoor space comprises a gallery in a museum containing one or more particular works of art.

7. The method of claim 6, further comprising the steps of:

creating the risk map using the real-time data and characteristics of the particular works of art in the gallery to determine an impact the environmental conditions in the gallery have on the particular works of art in the gallery; and generating the alert whenever the risk map indicates that the environmental conditions in the gallery pose greater than a predetermined threshold level of risk of damaging the particular works of art in the gallery.

8. The method of claim 6, further comprising the step of:

regulating the visitor flow in the gallery based on the alert by closing off the gallery to new visitors.

9. The method of claim 6, further comprising the step of:

regulating the visitor flow in the gallery based on the alert by sending a mobile app to visitors to direct the visitors to one or more other galleries in the museum.

10. The method of claim 1, wherein the indoor space comprises a room in a hospital having one or more patients.

11. The method of claim 10, further comprising the steps of:

creating the risk map using the real-time data and characteristics of the patients in the room to determine an impact the environmental conditions in the room have on a risk of infection for the patients; and generating the alert whenever the risk map indicates that the environmental conditions in the room pose greater than a predetermined threshold level of risk of infection for the patients in the room.

12. The method of claim 10, further comprising the step of:

regulating the visitor flow in the room based on the alert by closing off the room to new visitors.

13. The method of claim 1, wherein the creating step further comprises the step of:

modeling airflow throughout the indoor space.

14. The method of claim 13, wherein the airflow throughout the indoor space is modeled using computational fluid dynamic (CFD) analysis.

15. The method of claim 1, wherein the creating step further comprises the step of:

determining an amount of one or more of a temperature, a relative humidity, and a $CO_2$ level in the indoor space that is attributable to the presence and the number of visitors in the indoor space.

16. The method of claim 15, wherein the determining step is performed using human body modeling.

17. A system for managing visitor flow in a gallery of a museum containing one or more particular works of art, the system comprising:

a CFD modeling module configured to obtain real-time data relating to one or more environmental conditions in the gallery from a wireless sensor network present in the gallery, and create a CFD model of the gallery;

a human body modeling module configured to obtain real-time data relating to a presence and a number of visitors in the gallery from the wireless sensor network, and create a human body model that indicates an amount of one or more of a temperature, a relative humidity, and a $CO_2$ level in the gallery that is attributable to the presence and the number of visitors in the gallery;

a preservation modeling module configured to create a preservation model based on characteristics of the particular works of art in the gallery; and a blending module configured to combine the CFD model, the human body model, and the preservation model to create a risk map to determine an impact the environmental conditions in the gallery have on the particular works of art in the gallery.

18. The system of claim 17, further comprising:

an alert module configured to generate an alert whenever the risk map indicates that the environmental conditions in the gallery pose greater than a predetermined threshold level of risk of damaging the particular works of art in the gallery.

19. A system for managing visitor flow in a room in a hospital having one or more patients, the system comprising:

a CFD modeling module configured to obtain real-time data relating to one or more environmental conditions in the room from a wireless sensor network present in the room, and create a CFD model of the room;

a human body modeling module configured to obtain real-time data relating to a presence and a number of visitors in the room from the wireless sensor network, and create a human body model that indicates an amount of one or more of a temperature, a relative humidity, and a $CO_2$ level in the room that is attributable to the presence and the number of visitors in the room;

a risk of infection modeling module configured to create a risk of infection model based on characteristics of the patients in the room; and a blending module configured to combine the CFD model, the human body model, and the risk of infection model to create a risk map to determine an impact the environmental conditions in the room have on a risk of infection for the patients.

20. The system of claim 19, further comprising:

an alert module configured to generate an alert whenever the risk map indicates that the environmental conditions in the room pose greater than a predetermined threshold level of risk of infection for the patients in the room.

* * * * *